US005987842A

United States Patent [19]

Klein

[11] Patent Number: 5,987,842

[45] Date of Patent: Nov. 23, 1999

[54] STEEL HOUSE FRAMING CONSTRUCTION PANELS

[76] Inventor: Alfred Leonard Klein, P.O. Box 829, Williamsburg, N.Mex. 87942-0829

[21] Appl. No.: 09/007,329

[22] Filed: Jan. 15, 1998

[51] Int. Cl.[6] ..... E04C 3/04

[52] U.S. Cl. ..... 52/656.1; 52/690; 52/736.2; 52/737.2

[58] Field of Search ..... 52/693, 638, 653.1, 52/656.1, 656.2, 690, 736.2, 737.2

[56] References Cited

U.S. PATENT DOCUMENTS

| | | | |
|---|---|---|---|
| 925,677 | 6/1909 | Belcher | 52/693 |
| 1,924,881 | 8/1933 | Ragsdale | 52/693 |
| 2,152,189 | 3/1939 | Henderson | 52/167 |
| 2,514,607 | 7/1950 | Mclean | 52/638 |
| 2,963,127 | 2/1960 | Manville | 52/693 |
| 4,102,108 | 7/1978 | Cody | 52/693 |
| 4,106,258 | 8/1978 | Lindsay | 52/693 |
| 4,615,157 | 10/1986 | Murray | 52/167 |
| 4,720,956 | 1/1988 | Wiklund | 52/648 |
| 5,619,823 | 4/1997 | Ruff et al. | 49/504 |
| 5,647,186 | 7/1997 | Donaldson | 52/653.1 |
| 5,680,738 | 10/1997 | Allen et al. | 52/729 |

*Primary Examiner*—Christopher T. Kent
*Attorney, Agent, or Firm*—John P. Halvonik

[57] ABSTRACT

A metal construction unit comprising the connection of rail type channels with hat type channels. A plurality of such metal hat channels may be attached to a pair of such rail channels. Hat channels being "U" shaped with side extensions at the top of the "U" and the rail channels having a base portion with upright portions extending perpendicular to the base so as to divide the base into left, right and middle portions. Both side flanges of each hat channel in the group are connected to one of the flanges of each of the rails. Similar construction would take place on the other side of the top and bottom rail with another set of hat channels.

3 Claims, 7 Drawing Sheets

STEEL HOUSE FRAMING CONSTRUCTION PANELS

FIELD OF THE INVENTION

The invention relates to the field of construction using steel or metal framing members, and in particular to a novel combination of a plurality of metal hat channel members in connection with a pair of metal rail members in order to produce a novel steel framing unit for use in steel house constructions.

BACKGROUND AND PRIOR ART

While there are metal framing methods in the prior art none of them are of the construction of the applicant's invention. Specifically the applicant's invention recites the use of two metal hat channels that are used in connection with a metal rail member in order to produce a novel metal framing unit.

SUMMARY OF THE INVENTION

A metal construction unit is formed from by attaching a plurality of metal hat channel members to one of the flanges projecting from a metal rail unit. A plurality of such metal hat channels may be attached to a pair of such rail channels. Each of the metal hat channel members would be seen to be in an upright condition and the metal rail members would be perpendicular to the line of the hat channels; i.e. the rail members would be horizontal and the hat channel members would be vertical when the units are used in the construction of a metal building. At least two rail units should be used to connect a plurality of hat channels so that both the top and the bottom of each hat channel member is connected to one side of a rail unit. Both side flanges of each hat channel in the group are connected to one of the flanges of each of the rails. That is, both side flanges of the hat channel would be connected to that flange on one side of the top and bottom rail. Similar construction would take place on the other side of the top and bottom rail with another set of hat channels.

Further reinforcement may come in the form of a plurality of flat steel members that are connected at an angle from the top rail to the bottom rail so as to form an "X" shaped pattern of flat metal reinforcement members. Each pair of flat reinforcing members should go underneath the hat channel units at that point where the flat members cross one another.

It is an object of the invention to provide a superior metal frame construction unit that can resist stresses from a number of different directions.

Another objective of the invention is to provide a metal construction panel that will reduce the amount of surface contact points between the inside and outside members of the panel and so provide metal constructions that will lose less heat than competing metal constructions.

Another objective is to provide hat channel shaped members as load bearing structures in metal framing constructions.

Other objectives will be known to those skilled in the art once the innovation is shown and described.

PREFERRED EMBODIMENT

Figure 10:
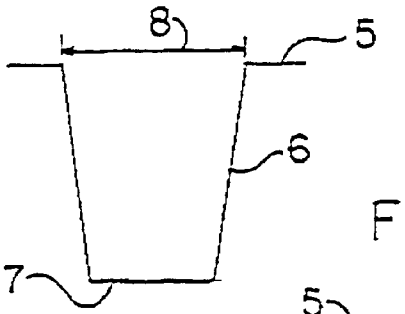
FIG. 10 side view of hat member corrections made to numbering.
Figure 1:
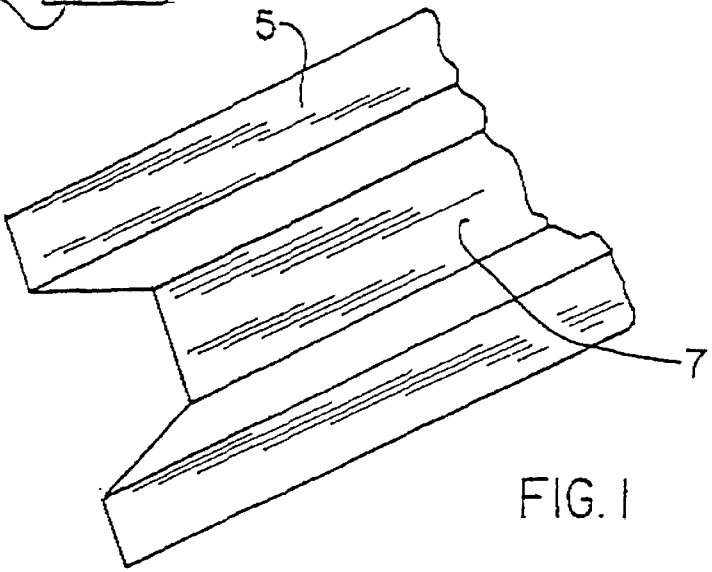
FIG. 1 view of hat channel member.

A typical hat channel member is shown in FIG. 1. It may also be referred to as a "perlin." Such units may be seen to resemble a top hat in shape when they are viewed from the side. This construction produces a lengthwise unit having a top portion 7 and two side flanges 5 on either side of the top portion and running parallel to the top flange. The top portion forms a plane that is parallel to the plane formed by the two side flanges and can be seen in FIGS. 1 and 10. The dimensions of the hat channel may vary with the preferred construction having side flanges about 1" in width and the top portion should be about 1.5" in width. The raised walls 6 that connect the top portion to the side flanges should be about 1.5" in height. As these walls are not perpendicular to the top portion but rather, at a less than 90° angle to it, the opening 8 between the side flanges should be about 2".

Figure 2:
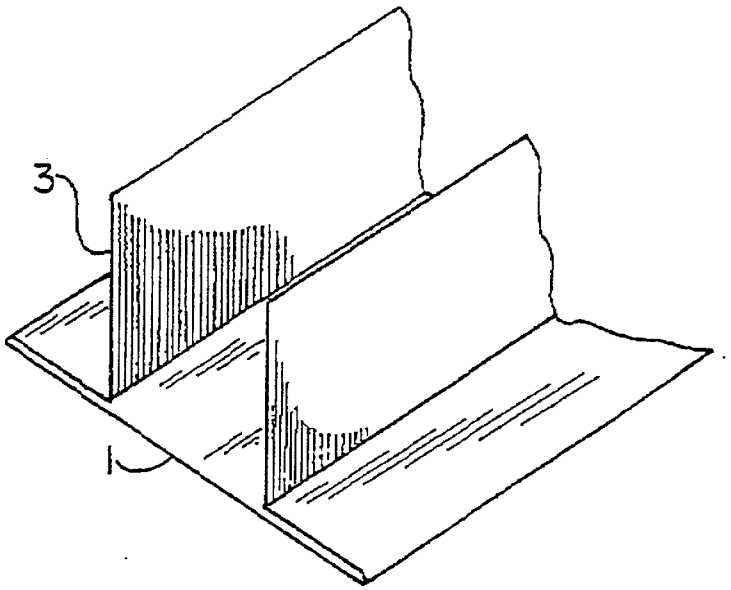
FIG. 2 view of a rail member.
Figure 11:
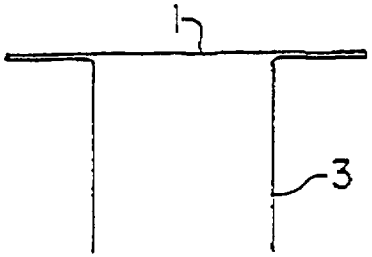
FIG. 11 side view of rail member.

The rail channel is seen in FIGS. 2 and 11 and has a flat base member 1 in connection with two flanges 3. The flanges are perpendicular to the plane formed by the base member and run in direction parallel to the base. The flanges are smaller in width than the base member and are likely to be the same length as the flanges will run the length of the base member. The size of the rail member can vary with 6", 8", 10" and 12" width, found to be useful. The base of the rail may be of doubled steel for sturdier construction. The preferred width of the base member should be about 6" and the height of each of the flanges should be about 3". The flanges should extend from a ooint on the base about 1.5" from the edge of the base so as to leave about 3" space between each of the flanges When viewed from the side (FIG. 11) this shape may also be said to resemble a stove pipe type of hat. Unlike the hat channel, however, the hat shape of a rail member is open at the top of the "hat." For purposes of convention that member shown in FIGS. 2 and 11 and decribed above will be referred to as the rail channel or rail member and that shown in FIGS. 1 and 10 will be referred to as the hat channel or hat member.

Figure 8:
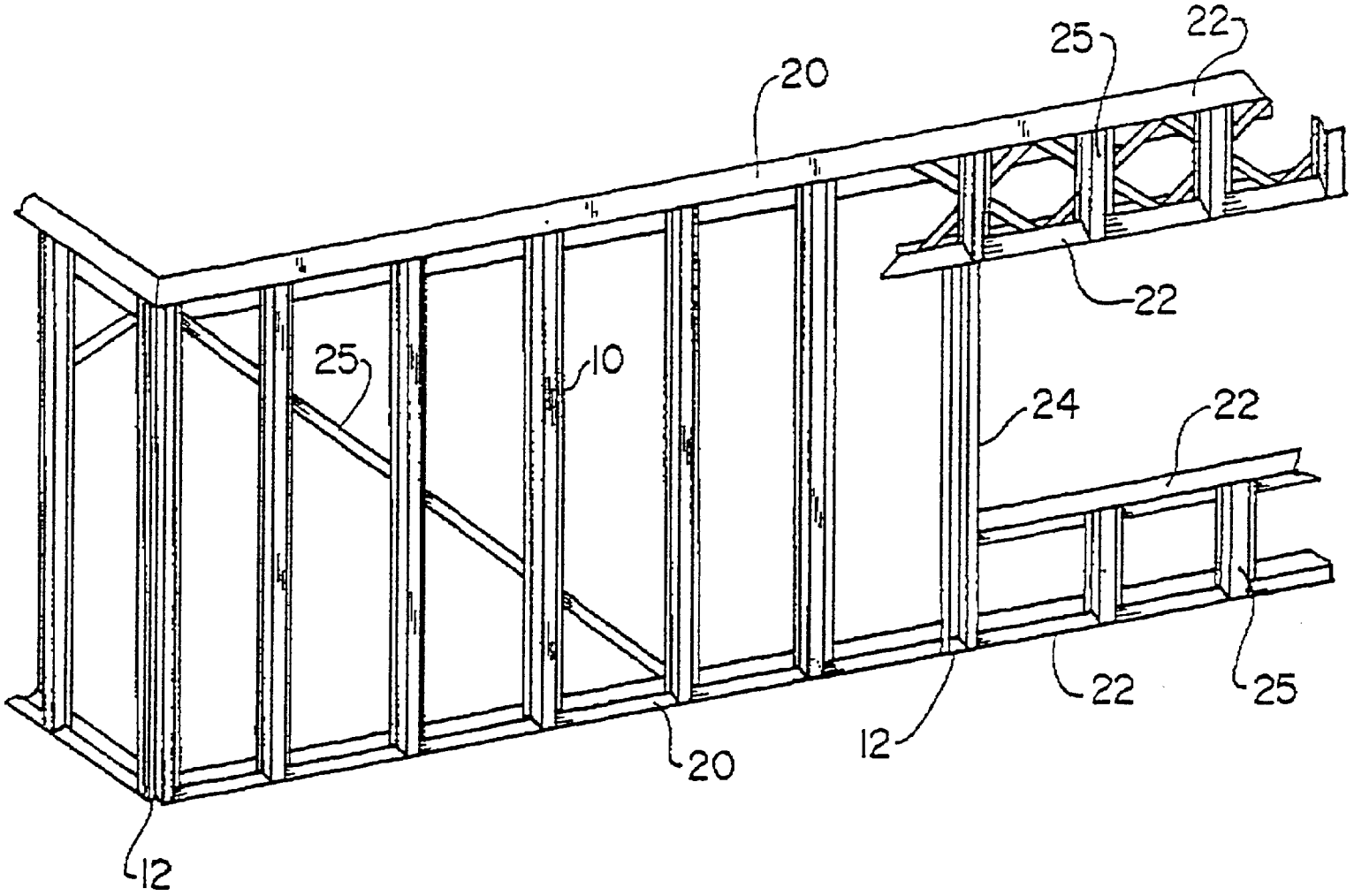
FIG. 8 detail of outside wall with corner bracing and window header.

When used to form a construction panel, as in FIG. 8, a plurality of such hat channels 10 and 12 should be attached to a pair of rails 20. These rails may be referred to as the top and the bottom rail because the top rail connects all the top portions of the hat channels and the bottom rail connects all of the bottom portions of the hat channels when seen in FIG. 8. Because of the nature of the shape of the rail channel, each of the hat channels in the series will be connected to the smaller flange portion 3 of the rail channel. 12 is a hat channel identical to 10 but is used in the inverted orientation, see corner construction discussion below.

In this manner, a first set or plurality of hat channels are oriented in an upright manner and connected to one of the side flanges of the top rail. Likewise, the bottom portions of each of these hat channels are connected to a second or bottom rail in the same manner. I.e. the bottom sections of the hat channels are all connected to one of the side flanges of the bottom rail. The resulting construction then forms one of the two sides of the building construction, say the outside. A similar number of hat channels are then attached to the opposite side flange (i.e. that side flange of the rail member that wasn't used for the first set) of the rail member to form the inside of the construction panel. These can be more clearly seen in FIGS. 3 and 4. The second set of hat channels are attached to the others flange of each of the two rails, i.e. that flange not used to connect the first set of hat channels. So that when the panel is finished, both of the flanges of the rail will be connected to a plurality of hat channels.

Figure 4:
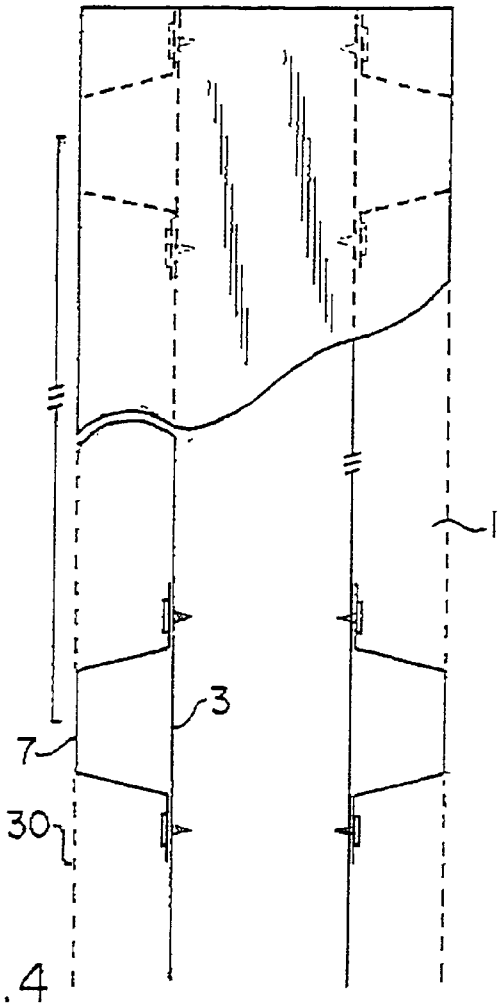
FIG. 4 top view of wall construction unit.
Figure 3:
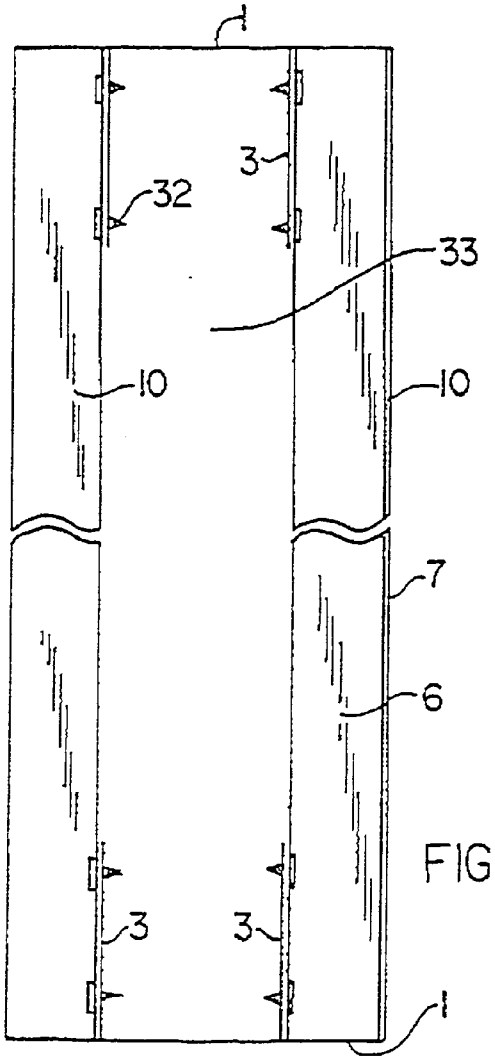
FIG. 3 end view of wall construction unit.

FIG. 3 shows an end view of this construction with a rail member (1 and 3) on the top and bottom and hat channels 10 seen from the side. There is a hat channel on each side of the top and bottom rails. One side may be thought of as the outside of the house and the other may be thought of as the inside wall of the house. The inside surface would be formed by the top portion 7 of the hat and this offers a surface for the attachment of sheet rock or other types of material for the inside wall of the building or home. The space 33 between the two hat channels may be filled with insulation. FIG. 4 shows view from the top; the base portion 1 of the rail has been cut away to show the hat channels. The preferred distance between each of the upright hat channels would be about 2 feet from the center of each.

Attachment of the rail channel to the hat channels may be by any state of the art means such as: spot welds, bolts, rivets, etc. It is preferred that the four self threading metal screws 32 (or four spot welds) be used at the top and bottom of each hat channel in order to connect each of the hat channels to the rail (see FIG. 3). The hat channels are available commercially. The rail units may be rolled from 8 or 10 gauge steel, for example. Further reinforcement may be had by the use of flat steel 25 or other metal members that may be connected in criss cross fashion to connect the top and bottom rails to one another. This will produce an "X" pattern as seen in FIG. 5.

Such a construction will produce a wall unit that is self bracing and has minimal contact between the outer surfaces formed by the outer hat channels and the inner surfaces also formed by hat channels. The rails connect each of these surfaces to one another but as the rails only connect a minimal amount of the surface of the hat channels, the contacts points are reduced.

Figure 13:
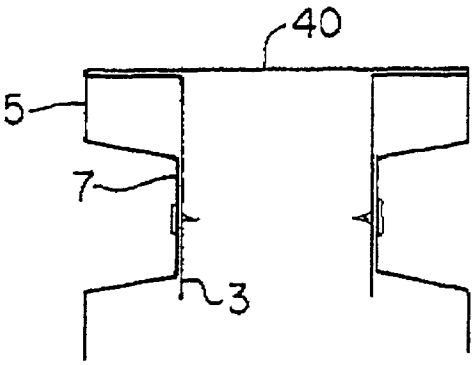
FIG. 13 top view of window and door jamb with inverted hat channel application.
Figure 6:
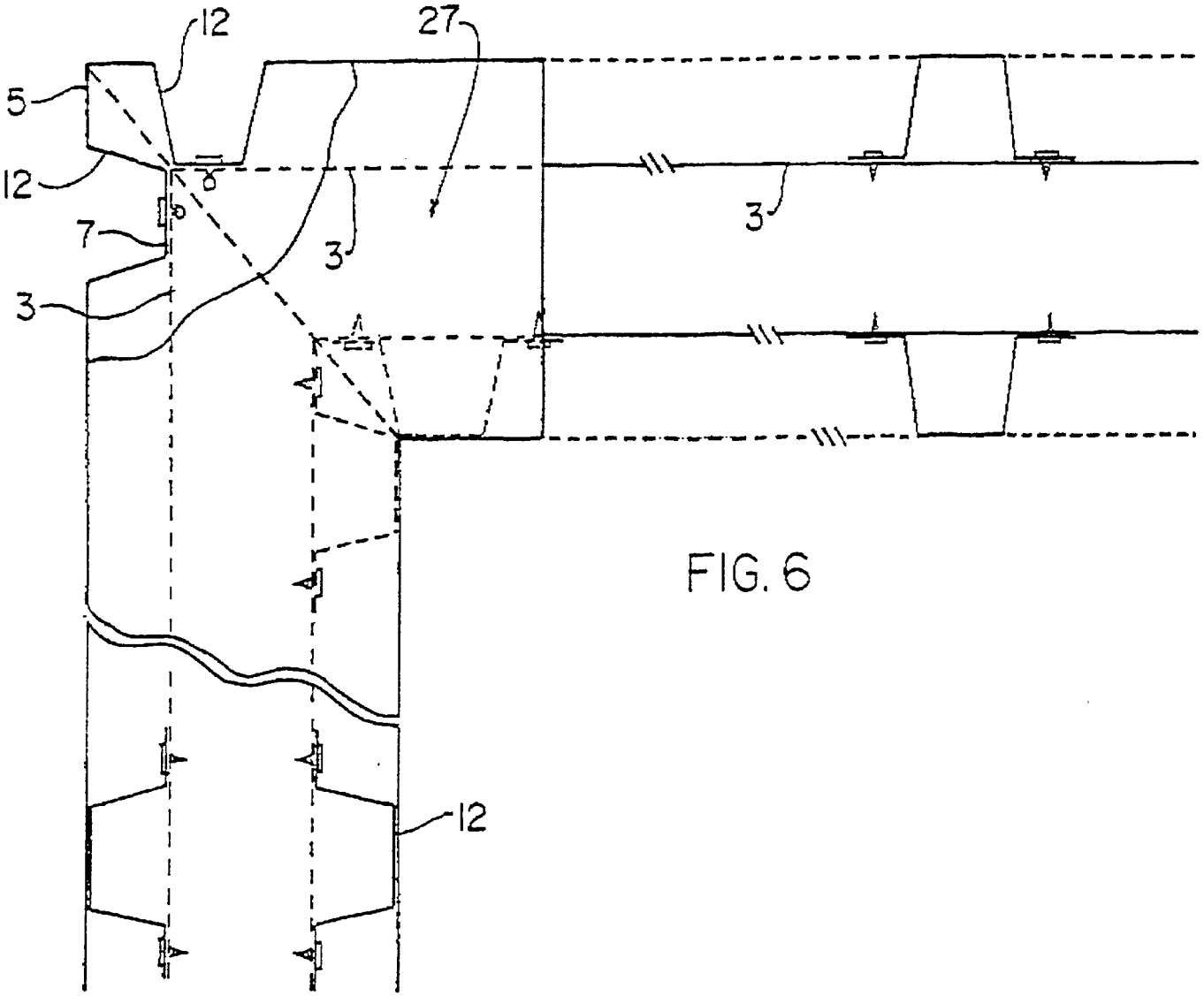
FIG. 6 detail of corner construction.

Alternately in the corner construction, hat channels may be attached to the rails using an inverted method. Unlike the method described above, in this case the top part 7 of the hat would be connected to the flange 3 of the rail instead of using the side flanges 5 of the hat. This is shown in the corner detail FIG. 6 where those two hat channels 12 that meet to form a corner are inverted so that their side flanges will touch one another at the corner of the building. A top plate or angle corner brace 27 may be used to connect the tops of the rail channels to one another as well as the hat channels. This is cut away in FIG. 6 to show the hat channels but in reality, the angle brace will overlie both hat channels at the corner. This plate should be about the same width as the rail and maybe an angled piece of flat metal attached (by bolts, welds, or similar) to the top of the corner in order to hold it together and bridge the angle of the corner. The inverted method is also shown in FIG. 13.

Figure 5:
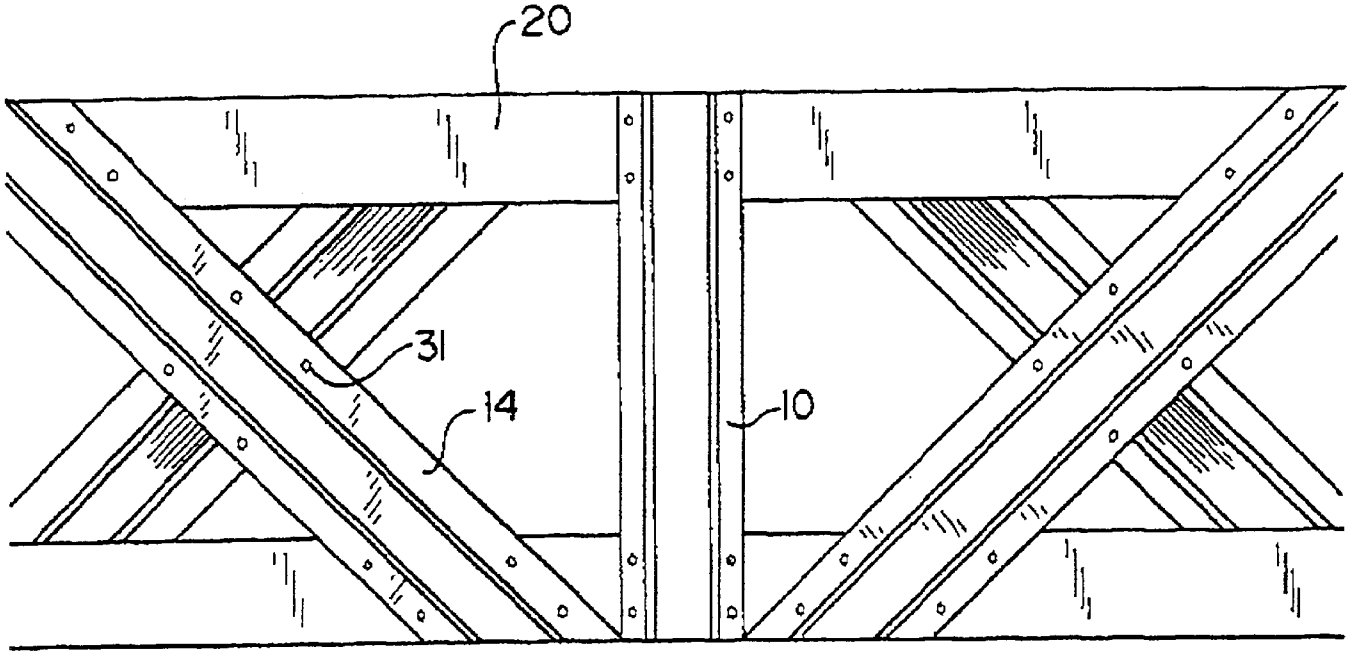
FIG. 5 flat roof truss and free span floor joist using hat and rail construction.

FIG. 5 shows similar method for constructing flat roof trusses and free span floor joists. The method is modified as a second set of hat channels 14 are used in criss cross fashion to connect the top rail to the bottom rail. These hat channels should be attached to the flanges of the rails through the top flanges of the hat, i.e. the same method (normal method) used to attach the upright hat channels. In this method, the criss crossed hat channels may be seen as pairs with one of the pair on one side of the rails and the other of the pair on the other side of the rails. Such pairs may be used across the entire structure. Each of the pairs may be attached to one another by welds, bolts, etc. at that point 31 where the two hat channels cross one another.

Upright hat channels 10 are also attached through the normal manner, i.e. they are in vertical orientation and attached by their flanges to one flange of both a bottom and a top rail. Again, it is preferred that there be about 2' between each of the vertical hat channels. The height of the hat channels used in this construction can vary with 16" found to be one useful height. As in the method described above, a second set of vertical hat channels may be used on the inside of the rails to attach to the other side of the bottom and top rails.

Figure 7:
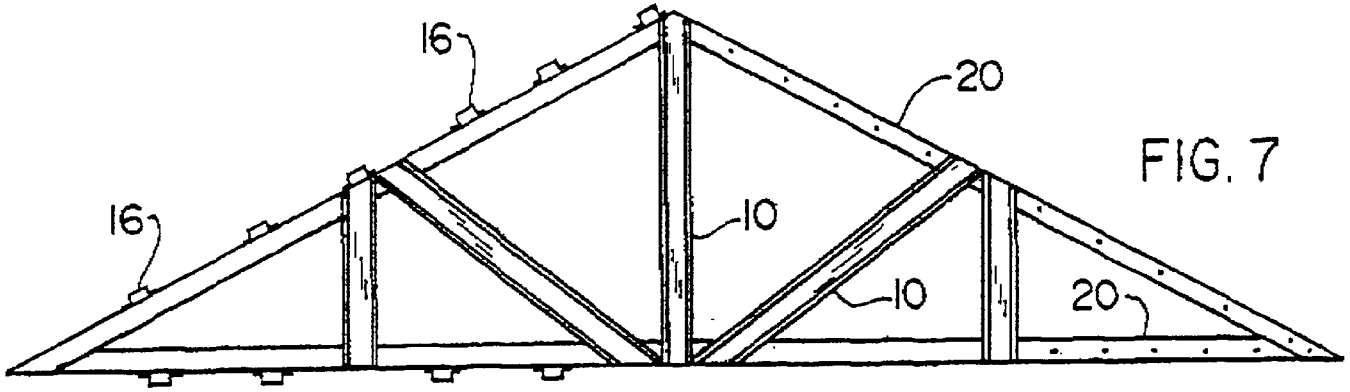
FIG. 7 detail of pitched truss construction.
Figure 12:
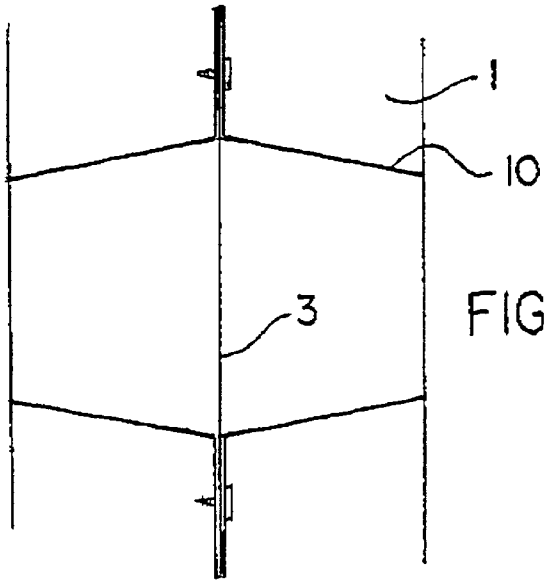
FIG. 12 top view of pitched truss detail.

FIG. 7 shows similar construction for a pitched truss and roof. Rails 20 are connected to one another in triangular formation. Hat channels 10 are used to connect the rails to one another as shown. Some of the hat channels are vertical and others are at an angle to the rails. A further set of hat channels 16 is shown connecting across the top of the roof to form a surface for the attachment of a roof membrane. The hat channels are connected in the "normal" fashion by attachment of their flanges to the rails. In this case, a second set of special 3" rail channels (FIG. 14) should be used directly behind those hat channels shown as 10 in FIG. 12 which is a top view of the resulting construction. The single flange of the special rail channel is shown as 3 in this drawing.

Figure 14:
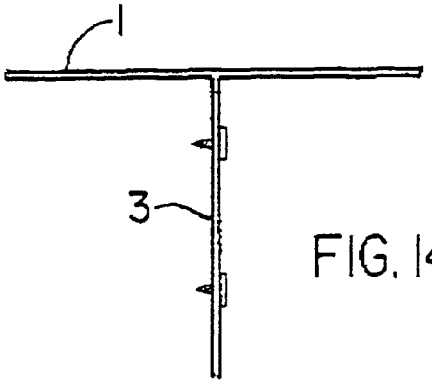
FIG. 14 special hat channel.

It is preferred that special 3" rail channels be used for the pitched trusses, flat trusses and floor joists but not for headers over the door or window openings. The truss spacings should be 4' from center to center with perlins 2' apart from center to center. These spacings are for roof and ceiling membranes. The special 3" rails are shown in FIG. 14. The base 1 is merely 3" wide and in this case the two flanges (part 3) abut one another so as to appear as if there is only one flange when in fact, they are two flanges bolted or otherwise connected to one another. In the case of headers, the wall rails are the normal construction shown in FIG. 11.

Figure 9:
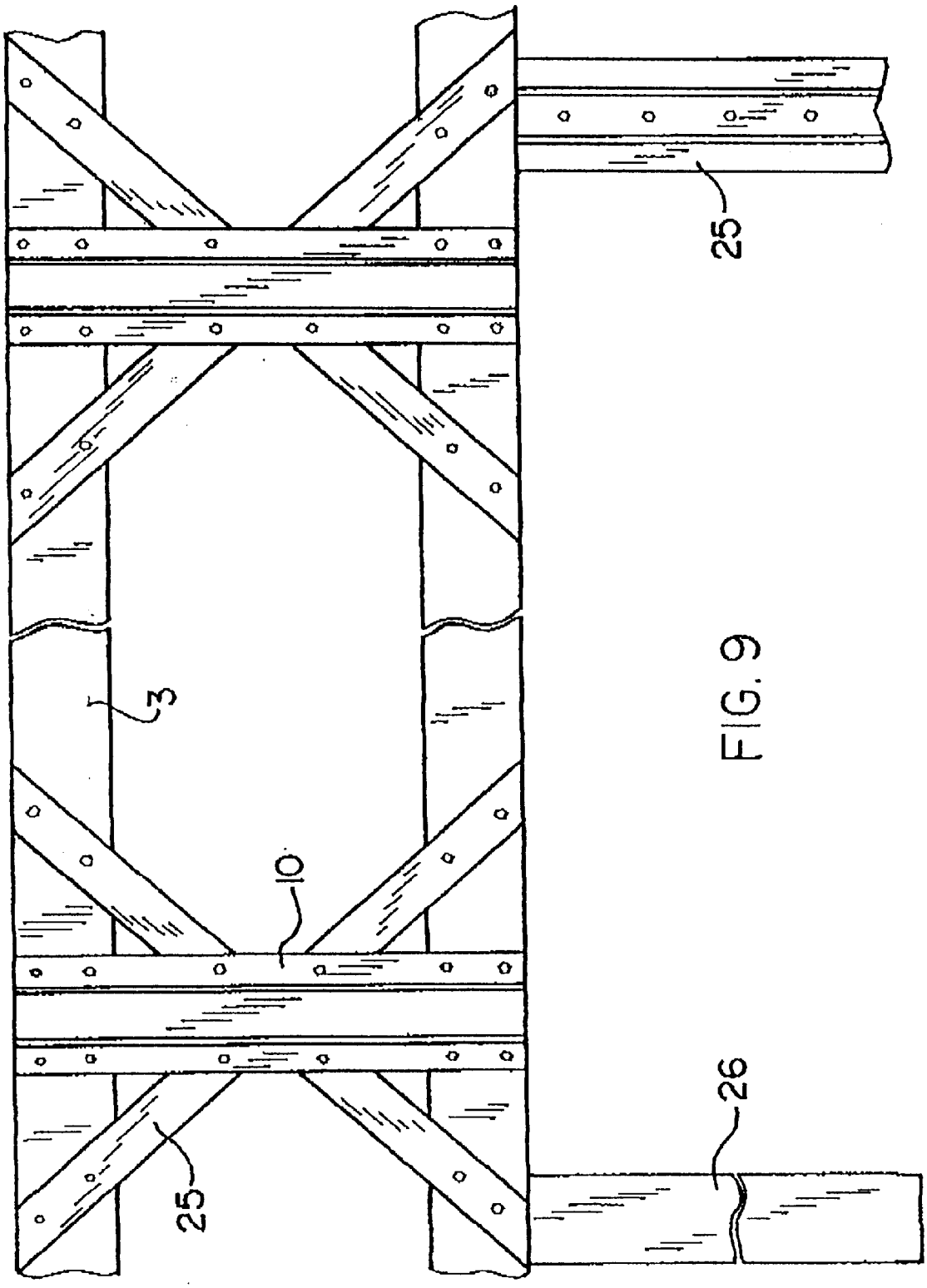
FIG. 9 detail of door and window header.

FIG. 9 shows door and window header detail of the header used in FIG. 8. The right hand side of FIG. 8 shows header in the wall with rail channels 22 being used at the top and bottom of each header. Another rail 24 is also used in vertical fashion at the side of the window space for load assembly. These rails 22 and 24 are identical in construction to that described above. Shorter hat channels 25 connect the rail channels 22 to the top and bottom rails as necessary. The method of attachment is similar to the first method described above, with hat channels attached in the "normal construction." In FIG. 9 a portion of the bottom of the rail channel has been removed in order to allow the bottom end of the hat channel to fit against this rail.

For additional stiffress and load bearing two hat channels are attached to the flanges of the upright or vertical rail channels 26 but here the hat channels 25 are attached in an "inverted" fashion so that the flange of the hat channel meets the edge of the rail channels as show in FIG. 13. This method is used for all door and window jambs. The window sill would be a regular rail channel with the wall below this constructed as the regular wall. FIG. 13 shows a top view of the window and/or doc)r jamb. That side 40 in FIG. 13 faces the door or window opening. The hat channel is used in the inverted method of application. Top part of hat channel 7 is attached by bolts, welds, etc. to the inner wall 3 of the rail channel in this application.

Additional corner braces 25 may comprise flat metal portions and can be used to connect the top and bottom rails to one another. This may be used on the outside wall, i.e. those series of hat channels that are connected to the outside of the rails. These braces should go underneath the hat channels as shown. They may be 2" wide. A similar pattern may be used on the inside of the wall not shown in FIG. 9.

I claim:

1. A building component for building construction using metal sub units comprising: a top and a bottom rail member, each of said rail members comprising a rail base portion and a pair of rail flanges extending at a perpendicular angle to said rail base portion and running parallel to said rail base portion so as to divide said base portion into left, right and middle portions, each of said portions co-planar with said rail base portion and said middle portion located between said rail flanges and said left and right portions located on either side of said rail flanges; at least one hat channel in connection with said top and bottom rail members, said hat channel comprising a hat base portion of planar shape and having left and right side edges, said hat base portion having left and right side walls in connection with each side edge, each said side wall extending upward from said hat base portion and having a pair of hat flanges, each said hat flange in connection with each said side wall, each said hat flange extending in outward manner from said side walls so that said hat flanges do not overlie said hat base portion; said hat channel connected to both said bottom and said top rail, said connection comprising both of said hat flanges of each said hat channel connected to one of said rail flanges of each of said bottom and said top rails so as to create a joined side of said rail members that is in connection with said hat flanges and a non joined side of said rail members that is not in connection with said hat flanges and opposite said joined side.

2. The apparatus of claim 1 having a second hat channel in addition to the first hat channel of claim 1, said second hat channel in connection with said top and bottom rails, said second hat channel attached to said non joined side of said rail members.

3. A building component for building construction using metal sub units comprising: a top and a bottom rail member, each of said rail members comprising a rail base portion and a pair of rail flanges extending at a perpendicular angle to said rail base portion and running parallel to said rail base portion so as to divide said base portion into left, right and middle portions, each of said portions co-planar with said rail base portion and said middle portion located between said rail flanges and said left and right portions located on either side of said rail flanges; at least one hat channel in connection with said top and bottom rail members, said hat channel comprising a hat base portion of planar shape and having left and right side edges, said hat base portion having a side wall in connection with each side edge, each said side wall extending upward from said hat base portion and having a pair of hat flanges, each said hat flange in connection with each said side wall, each said hat flange extending in outward manner from said side walls so that said hat flanges do not overlie said hat base portion; said base portion of said hat channel connected to said rail flanges of said top and bottom rail channels.

* * * * *